United States Patent [19]

Hamm et al.

[11] Patent Number: 4,982,718

[45] Date of Patent: Jan. 8, 1991

[54] ARROW RELEASE

[76] Inventors: Harry Hamm; Brian Hamm, both of 6210 Wintergreen Dr., Wisconsin Rapids, Wis. 54494

[21] Appl. No.: 356,551

[22] Filed: May 24, 1989

[51] Int. Cl.[5] ..... F41B 5/18

[52] U.S. Cl. ..... 124/35.2

[58] Field of Search ..... 124/35 A, 35 R, 31, 124/35.2, 35.1

[56] References Cited

U.S. PATENT DOCUMENTS

| | | | |
|---|---|---|---|
| 4,062,339 | 12/1977 | Wilson | 124/35 A |
| 4,249,507 | 2/1981 | Marra | 124/35 A |
| 4,476,845 | 10/1984 | Rickard | 124/35 A |
| 4,485,798 | 12/1984 | Hamm | 124/35 A |
| 4,489,705 | 12/1984 | Larson | 124/35 A |
| 4,620,523 | 11/1986 | Peck | 124/35 A |

*Primary Examiner*—Peter M. Cuomo
*Attorney, Agent, or Firm*—Carl E. Gulbrandsen

[57] ABSTRACT

An improved release for a bow string comprising: a base member, a sear, a latch for releasably holding the sear, and an operating device for moving the latch and freeing the sear to release the bow string. The latch is pivotally connected to the base member and the operating device is slideably carried by the base member, such that relative movement between the operating device and the base member operates the latch. An adjustment device is provided for changing the bias force supplied to the operating device and for changing the distance that the operating device has to move before engaging the latch. The base member can be supported in by the hand in either Concho style or wrist style.

8 Claims, 2 Drawing Sheets

ARROW RELEASE

TECHNICAL DESCRIPTION

This invention relates to the general subject of archery and, in particular, to the subject of mechanical bow string or arrow releases.

TECHNICAL FIELD

Those skilled in the art know the advantages of releasing an arrow by means of a mechanical release as opposed to releasing an arrow with fingers alone. Specifically, a mechanical bow string release increases the uniformity of release and thereby the accuracy of arrow flight.

An especially useful release is disclosed in U.S. Pat. No. 4,485,798. There, a bow string release is disclosed that incorporates features which allow it to be adjusted to the requirements of the user. For example, it features a rotatable handle and a reversible trigger.

Those skilled in the art also know that shooting an arrow at a target is considerably different from that of shooting an arrow at a wild animal. An animal's movements cannot be predicted. Moreover, when one is in the forest stalking game, the animal can come into shooting range suddenly and without warning. The animal can leave just as quickly; it takes a skilled archer to aim and release an arrow with accuracy on short notice. The uncertainty and lack of ease which some archers exhibit when shooting at live game has been termed "target panic". For this reason, some bow hunters have avoided mechanical releases and have preferred to use their fingers alone. Basically, those effected by target panic do not release their arrows smoothly. The arrow is released too quickly, too slowly, or without smoothness. This has been referred to as punching, creeping, freezing, and collapsing.

What is needed is a foolproof, all-mechanical, self-loading release that refuses to be punched or triggered on command. In particular, a surprise release is what is needed. Moreover, it would be desirable if such release was available in Concho or wrist style. In addition, it would be preferably that such a release be provided with a means for adjusting the force and/or stroke needed to release the bow string. It would be also desirable to provide means, selected at the option of the user, for changing the manner in which the user grasps or holds the device to cause a release of the bow string. Such a release would advance the art and would be quickly accepted not only by archers and hunters, but also by target shooters.

SUMMARY OF THE INVENTION

In accordance with the present invention an improved release for a bow string is disclosed. Specifically, the release comprises: a base member, a sear which is pivotally carried by the base member a latch for releasably holding the sear for movement between a released position and a captured position, and operating means for operating the latch and freeing the sear for pivotal movement.

In one specific embodiment, the base member comprises a barrel shaped body which has a slotted opening at one end for receiving the bow string and the operating means comprises a cylindrical sleeve which is slideably carried around the barrel shaped base member. The latch comprises a pivotally connected latch member which is biased to a sear restraining position by a bias spring. The cylindrical sleeve includes an engaging means for engaging the latch member and for overcoming the bias spring means to release the sear for pivotal movement. The operating means includes a biasing spring for biasing the sleeve for movement opposite to that which will release the sear from its captured position. Moreover, there is a bias adjusting means for changing the bias force applied to the sleeve and a position adjusting means for changing the distance that the sleeve has to move before releasing the latch member. The barrel shaped base member may be adopted for a Concho or wrist style support.

From the foregoing, it is clear that the present invention overcomes the limitations of the prior art. Numerous other advantages and features of the present invention will become readily apparent from the following detailed description of the invention, the embodiments described therein, from the claims, and from the accompanying drawings.

DETAILED DESCRIPTION OF THE PREFERRED EMBODIMENT

Figure 1:
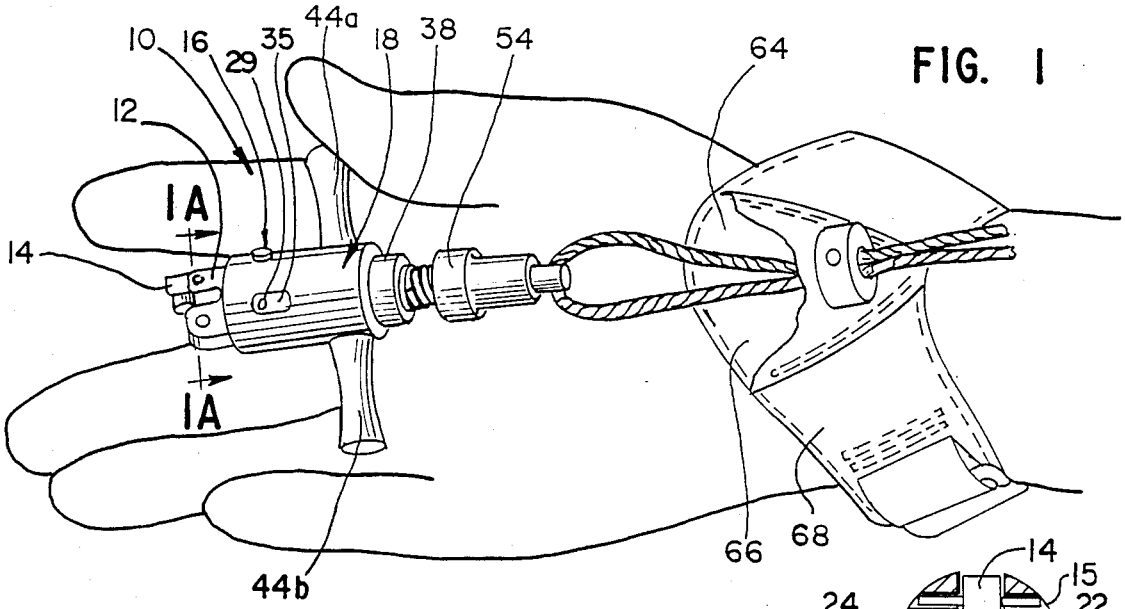
FIG. 1 is a plan view of the release that is the subject of the present invention, illustrating the manner in which the device is held in the archer's hand using a wrist strap.

While this invention is susceptible of embodiment in many different forms, there is shown in the drawings and will herein be described in detail one specific embodiment of the invention. It should be understood, however, that the present disclosure is to be considered as an exemplification of the principles of the invention and is not intended to limit the invention to the specific embodiments illustrated.

First the principal components of the invention will be described and then the operation of the invention will be explained.

PRINCIPAL COMPONENTS

Turning to FIG. 1, an improved release 10 is shown comprising: a base or body member 12, a sear 14, latch means 16, and an operating means 18. Preferably, those components which are subject to wear are fabricated from hardened steel and aluminum.

Figure 1A:
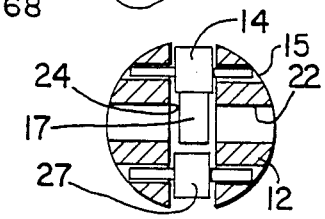
FIG. 1A is a front view of the release.
Figure 2:
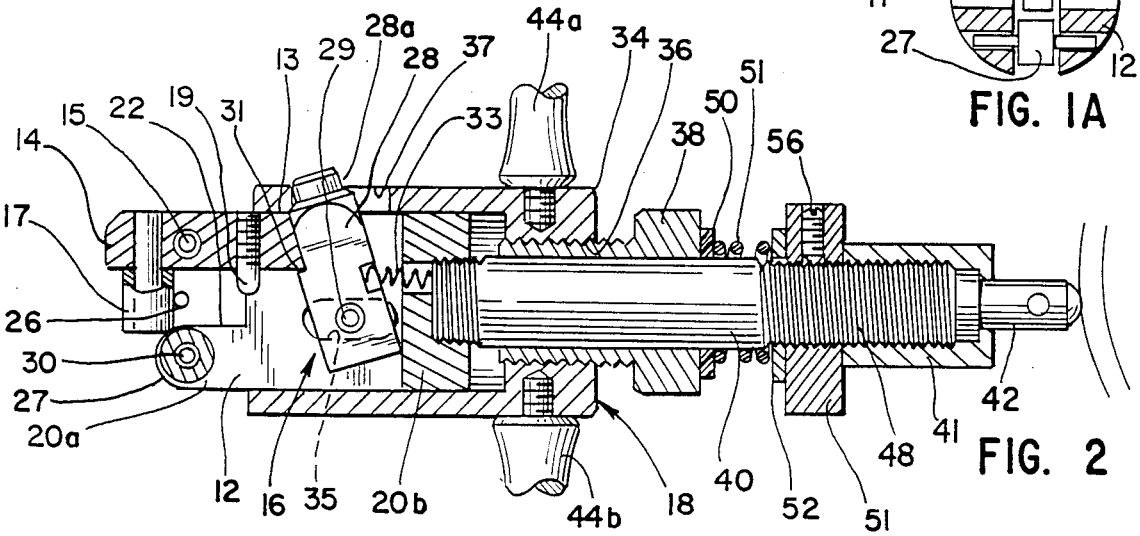
FIG. 2 is a cross sectional side view of the release shown in FIG. 1 with the bow string captured therein.

Referring to FIG. 2, the base member 12 is a generally cylindrical or barrel shaped element. One end **20*a* (the left-hand and, according to the orientation of FIG. 2) of the base member 12 have two slots or notches 22 and 24 which are arranged generally at right angles to each other (See FIG. 1A). The opposite or right-hand end 20*b* of the base member 12 is threadably connected to a base extension 40. The left-hand end of the base extension 40 is adapted to be connected to a Concho style support (See FIG. 5) or by means of a collar 41 and swivel 42 to a wrist support (See FIG. 1**). One of the slots 22 of the base or body member 12 is adapted to receive at its interior the bow string 26 of a bow.

The sear 14 is pivotally connected to one side of the other slot 24 of the base member 12 by means of a pivot pin 15 (See FIG. 1). The sear 14 is mounted within this slot 24 for pivotable movement between a bow string released position 14 (FIG. 3), and a bow string captured position (FIG. 2). A nylon roller 27 is located in the same slot 24 as the sear 14 by means of a pin 30. The roller 27 prevents over travel of the sear. The right-hand end of the sear 14 is adapted to be received by the latch means 16. The left-hand end of sear 14 has a bushing or retaining pin 17 to provide a good contact between the release 10 and the bow string 26. When the sear 14 is in its bow string captured position (see FIG. 2), the retaining pin 17 closes the open end of the bow string receiving notch 22. Another pin 19, located intermediate the ends of the sear, is used to cock the sear in its bow string captured position. This will be explained in greater detail later.

Figure 4:
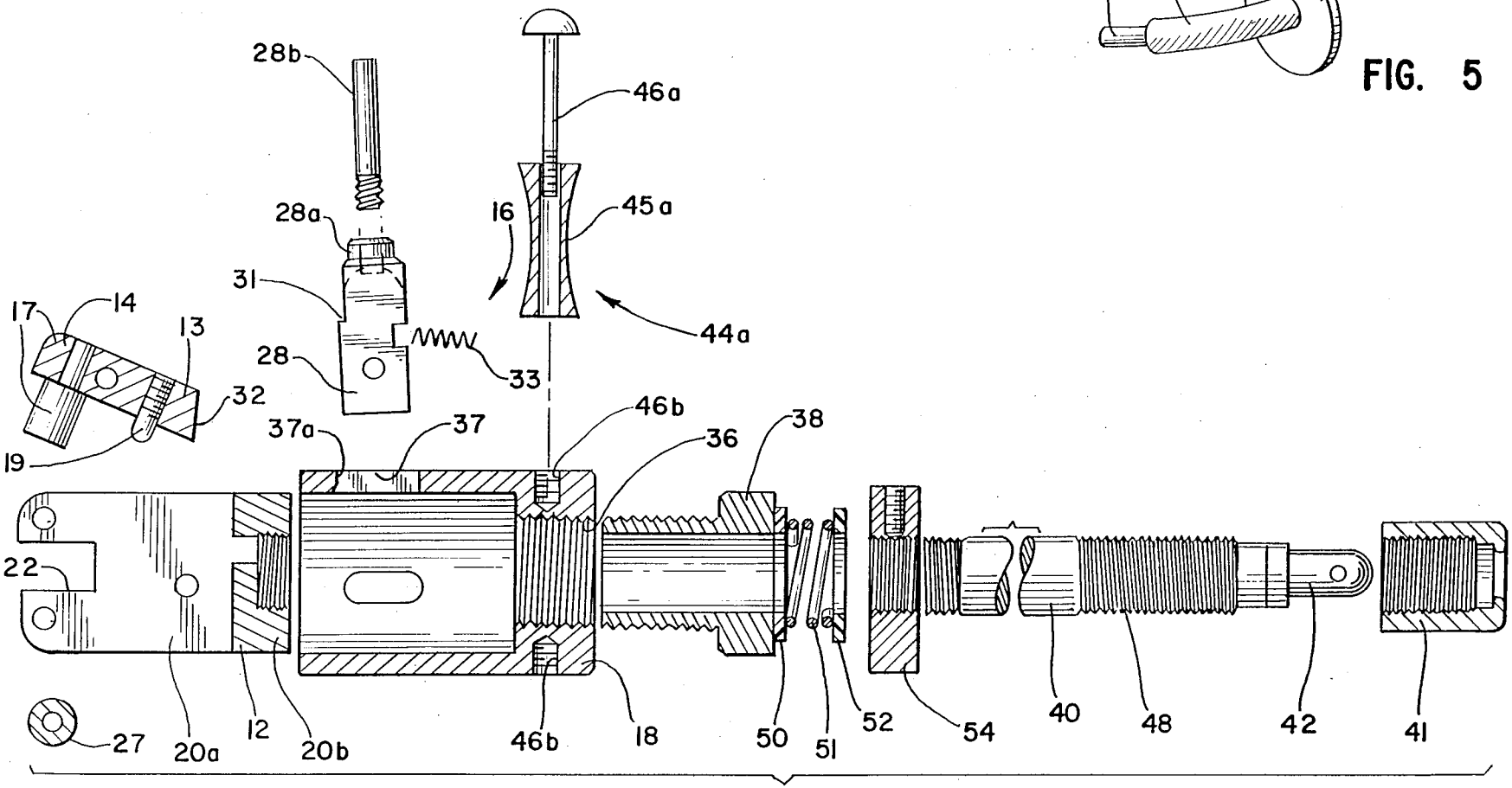
FIG. 4 is an exploded view of the major components forming the release shown in FIG. 2.

Turning now to the latch means 16, the latch means comprises a latch member 28 which is pivotally connected at one end to the base member 12 by a pivot pin 29. The forward or left-hand end latch member 28 has a notch 31 intermediate its ends for receiving the right-hand end 13 of the sear 14 when the sear is in its bow string captured position. In this embodiment the right-hand end 13 of the sear 14 has a beveled edge 32 which is adopted to fit within the notch 31 of the latch member 28. To facilitate adjustment and provide greater flexibility in operation, the upper or free end 28*a* of the latch member 28 may be provided with means for adding a threaded rod or member 28*b* (See FIG. 4). This allows direct control of the sear.

In addition, the latch means 16 comprises a spring or biasing device or spring 33 to keep the notch 31 of the latch member 28 engaged with the right-hand end or bevelled end 13 of the sear 14. The bias spring 33 is carried between the left-hand end of the base extension 40 and the latch member 28. Thus, when the bevelled end 13 of the sear 14 fits within the notch 31 of the latch member 28, pivotal movement of the sear is prevented.

The operating means 18 comprises a generally cylindrical sleeve 34 and collar 38 which slideably fits around the exterior of the rear or right-hand end 20*b* of base member 12 and its extension 40. In particular, the left-hand end of the sleeve 34 has a bore which fits around the right-hand end of the base member 12. The opposite or right-hand end of the operating sleeve 34 has a bore 36 to which the collar 38 is threadably joined. Preferably, the exterior surfaces of the sleeve 34 and the collar 38 are knurled to facilitate adjustment and movement with the fingers. The walls of the operating sleeve 34 have two opposite and generally oblong openings 35 and a single and larger opening 37. The free end 28*a* of the latch member 28 passes through the larger opening 37 in the sleeve 34. The two smaller openings 35 provide access to the pivot pin 29 which holds the latch member 28 in the base member 12. In addition, the right-hand end of the sleeve 34 contains a threaded opening 39 for receiving a lock or set screw to hold the collar 38 fixed in place relative to the sleeve.

The operating means 18 also includes two removable and generally opposite shaft-like members or finger grips 44*a* and 44*b*. In the embodiment illustrated in the drawings, each shaft-like member comprises an elongated hour-glass shaped grip sleeves 45*a* and a threaded fastener or screw 46*a* which passes through the center of the grip sleeves and which is secured to openings 46*b* (See FIG. 5) the operating sleeve 34. Preferably, the head of the screw 46*a* is knurled for easy removal. Some archers may prefer using the operating sleeve 34 alone; others may find it more comfortable to use one or more of the finger grips 44*a* and 44*b*, to move the operating sleeve 34 relative to base member 12.

Turning now to the base extension 40, the left-hand end of the base extension 40 is threadably connected to the right-hand end 20*b* of the base member 12 for ease of assembly, disassembly and repair. The base extension 40 is also provided with threads 48, located intermediate its ends, to receive a threaded adjusting collar 54. Preferably, the exterior surface of the adjusting collar 54 is knurled to facilitate turning it along the base extension 40. A lock or set screw 56 is threadably joined to the walls of the adjusting collar 54 to lock the adjusting collar in place relative to the base extension 40. Preferably, the lock screw 56 is adjusted by means of an allen wrench or similar device. Located on the base extension 40 and between the operating collar 38 and the adjusting collar 54 is a nylon washer 50, a bias spring 51, and another washer 52. Finally, the right-hand end of the base extension 40 is joined to a swivel 42 and swivel collar 41.

OPERATION

From the foregoing description of the components of the invention, it should be clear that when the sear 14 is in its bow string released position 14' (See FIG. 3), moving the bow string 26 into its receiving notch 22 causes the bow string to engage the cocking pin 19 at the right-hand end of the sear. Engagement of the cocking pin 19, causes the sear 14 to pivot counter-clockwise and the bevelled end 13 of the sear to engage the latch member 28 and over come the latch spring 33. Further counter-clockwise movement of the sear 14 pivots the latch member further in the clockwise direction. Eventually, the bevelled end 13 of the sear enters the notch 31 of the latch member 28 and the latch member 28 moves counter-clockwise under the force of its bias spring 33. Once the sear 14 is captured by the latch member 28, the sear is held in its bow string captured position (See FIG. 2). Thus, the release provides a self-loading feature or movement for the bow string.

Figure 3:
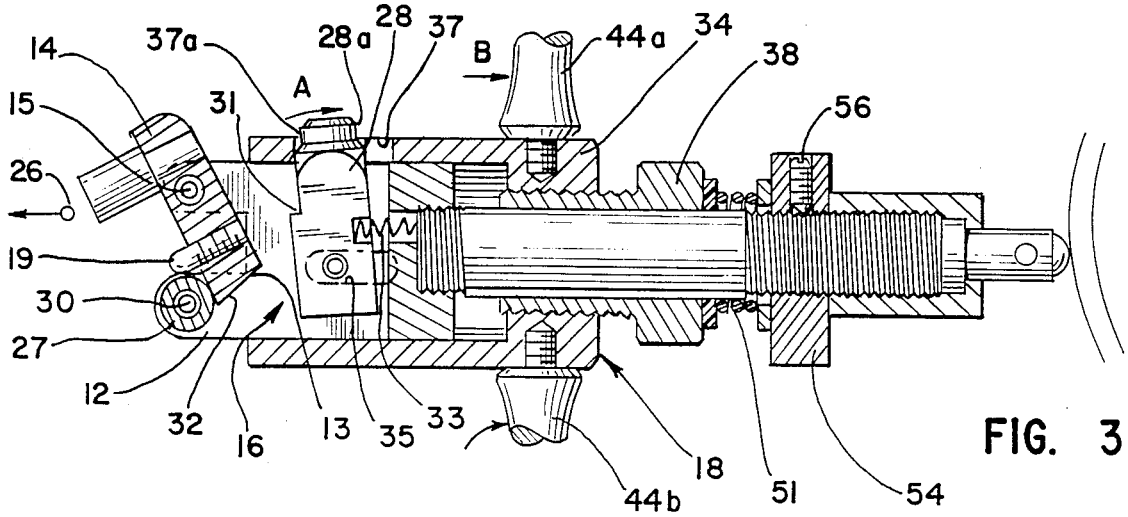
FIG. 3 is a cross sectional side view of the release shown in FIG. 1, just after the bow string is released.

When tension is applied to the front end of the sear 14, along string receiving pin 17, the sear has a tendency to rotate about its pivot pin 15 in a clockwise direction (according to the orientation shown in FIG. 2) from its bow string captured position to its bow string released position (See FIG. 3). This motion is restricted by the beveled edge 32 of the sear 14 being in contact with or engaging the notch 31 in the latch member 28.

Thus, to release the bow string 26, all that is needed is for the upper end 28*a* of the latch member 28 to move to the right or for the latch member to pivot clockwise about its pivot pin 29 (See arrow A in FIG. 3). This may be accomplished by means of the threaded extension 28*b*, a detachable "command trigger", or by sliding the operating sleeve 34 to the right (See arrows "B" in FIG. 3). More specifically, when the operating sleeve 34 is moved to the right, one edge 37*a*, the left-hand edge, of the large latch opening 37 engages the left-hand side of the free end or upper end of the latch member 28.

In the embodiments shown in the drawings, the release 10 is provided with two adjustments which the archer can use to modify the operating characteristics of the release. Specifically, there is the adjusting collar 54 and the operating collar 38. The adjusting collar 54 controls the force needed to move the operating means 18 rearwardly. It does this by compressing or relaxing the bias spring 51 on the base extension 40. The operating collar 38 effectively changes the position of latch opening 37 of the operating sleeve 34 relative to the base member 12, and, more specifically, relative to the latch member 28.

In summary, since right hand movement of the operating sleeve 34 is restricted by the bias spring 51, the amount of force that the archer need apply to the operating sleeve 34 can be adjusted by means of the adjusting collar 54. Moreover, by turning the operating collar 38 in and out of the operating sleeve 34, the relative position of the engaging end 37*a* of the latch opening 37 on the operating sleeve 34 may be changed relative to the latch member 28. Thus, the operating collar 38 allows the archer to adjust the trigger stroke or distance that his fingers need move to release the bow string. Once the preferred positions are obtained, set screws 56 (and one in opening 39) can be used to lock in place the adjusting collar 54 and operating collar 38.

Figure 5:
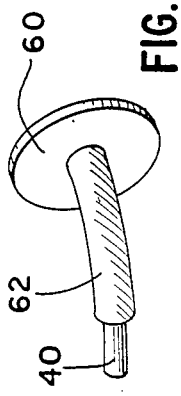
FIG. 5 illustrates a Concho support for the release that is the subject of the present invention.

Turning to FIG. 5, the release 10 may be carried by a palm held disk 60 and flexible extension 62 in Concho style. The release may also be carried by means of the swivel 42 and remote connection means or cable 64 to the pocket 66 of a wrist strap 68. See FIG. 1 manner of support is at the option of the user.

From the foregoing description, it will be observed that numerous variations, alternatives and modifications will be apparent to those skilled in the art. Accordingly, this description is to be construed as illustrative only and is for the purpose of teaching those skilled in the art the manner of carrying out the invention. Various changes may be made in the shape, size and arrangement of parts. In addition, equivalent elements may be substituted for those illustrated and described herein, parts may be reversed, and certain features of the invention may be utilized independently of other features of the invention. For example, the base extension may be made an integral part of the base member. Also the finger grips need not be provided or used. It will be appreciated that various modifications, alternatives, variations, etc., may be made without departing from the spirit and scope of the invention as defined in the appended claims. It is, of course, intended to cover by the appended claims all such modifications as fall within the scope of the claims.

I claim:

1. A bow string release, comprising:

(a) a generally barrel-shaped body member having an opening at one end for receiving the bow string and having an opposite end which is adapted to be carried by the palm of the human hand;

(b) a sear for releasably holding the bow string in said body member, said sear being carried at said one end by said body member for pivotal movement at generally right angles to the direction of movement of the bow string, said sear having a released position wherein the bow string is free to move out of said opening at said one end of said body member and having a captured position wherein the bow string is held within said body member;

(c) a latch for releasably holding said sear in said captured position, said latch including a latch member which has two opposite ends, one end of said latch member being pivotally connected to said body member for pivotal movement at generally right angles to the direction of movement of the bow string, said latch member having a disengaged position and having an engaged position wherein said sear is restrained from pivotal movement, said latch including biasing means for biasing said latch member in said engaged position; and (d) operating means, slideably carried around said body member for movement intermediate said ends of said body member, for overcoming said biasing means and moving said latch member from said engaged position to said disengaged position to free said sear for pivotal movement from said captured position to said released position, said operating means including:

engaging means for engaging said opposite end of said latch member when said operating means is moved in one direction relative to the ends of said body member; and position adjusting means for changing the distance said operating means moves in said one direction before said engaging means engages said latch member.

2. The release of claim 1, further including two opposite elements, removably carried by said operating means, for receiving two fingers of said human hand to move said operating means relative to said body member, said elements projecting along a line which is generally at right angles to the pivot axis of said sear.

3. The release of claim 1, wherein said body member comprises: a slotted element which has one end which carries said sear and said latch; and a body extension which is joined to the opposite end of said slotted element; wherein said operating means comprises a cylindrical sleeve having a bore at one end for slidably receiving said slotted element and an opening at the opposite end; and wherein said position adjusting means comprises a collar which is threadably joined to said opening at said opposite end of said cylindrical sleeve, said collar having a opening for slideably passing said body extension therethrough.

4. The release of claim 1, further including: a band which is removably wrapped around the wrist of said hand; and pocket means, carried by said band, for forming a relatively soft pocket in said palm of said human hand to receive said opposite end of said body member.

5. The release of claim 4, further including means, carried by said opposite end of said body member, for swivelly joining said band to said body member.

6. The release of claim 1, wherein said latch member removably carries at the end opposite said one end, a shaft-like member for receiving at least one finger of said human hand to move said latch member to said disengaged position.

7. An improved release, comprising:

(a) a slotted element which has an slotted opening at one end for receiving a bow string and which has an opposite end which is adapted to be connected to a palm held support;

(b) a sear, carried by said one end of said slotted element member to move between a bow string released position and a bow string captured position, for releasably holding said bow string in said slotted element;

(c) a latch member, having one end pivotally connected to said slotted element and having an opposite end, for restraining said sear from pivotal movement;

(d) biasing means, carried by said slotted element, for biasing said latch member to prevent pivotal movement of said sear; and (e) a cylindrical sleeve which is slideably carried around said slotted element for movement intermediate said ends of said slotted element, said sleeve having:

engaging means for engaging said opposite end of said latch member when said sleeve is moved in one direction relative to the ends of said slotted element and for overcoming said biasing means and moving said latch member to release said sear for pivotal movement from said captured position to said released position;

operating biasing means, carried by said slotted element, for biasing said sleeve for movement in a direction opposite to said one direction;

bias adjusting means, carried by said slotted element, for changing the bias force applied to said sleeve by said operating biasing means; and position adjusting means for changing the distance said engaging means moves in said one direction before engaging said opposite end of said latch member.

8. The release of claim 7, further including means for remotely connecting said opposite end of said slotted member to a wrist band.

* * * * *